US010665388B2

(12) United States Patent
Oshima et al.

(10) Patent No.: US 10,665,388 B2
(45) Date of Patent: May 26, 2020

(54) METHOD OF MANUFACTURING LAMINATED COIL COMPONENT

(71) Applicant: TDK CORPORATION, Tokyo (JP)

(72) Inventors: Yuya Oshima, Tokyo (JP); Makoto Yoshino, Tokyo (JP); Yoji Tozawa, Tokyo (JP); Junichi Otsuka, Tokyo (JP); Kazuo Iwai, Tokyo (JP); Yohei Tadaki, Tokyo (JP); Shinichi Kondo, Tokyo (JP); Kazuhiro Ebina, Tokyo (JP); Mamoru Kawauchi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 283 days.

(21) Appl. No.: 15/725,129

(22) Filed: Oct. 4, 2017

(65) Prior Publication Data

US 2018/0096789 A1 Apr. 5, 2018

(30) Foreign Application Priority Data

Oct. 5, 2016 (JP) ..... 2016-197143

(51) Int. Cl.
*H01F 41/04* (2006.01)
*H01F 27/28* (2006.01)
*H01F 17/00* (2006.01)

(52) U.S. Cl.
CPC ..... *H01F 41/043* (2013.01); *H01F 17/0013* (2013.01); *H01F 27/2804* (2013.01); *H01F 41/046* (2013.01); *H01F 2017/0066* (2013.01)

(58) Field of Classification Search
None
See application file for complete search history.

(56) References Cited

U.S. PATENT DOCUMENTS

| | | | | |
|---|---|---|---|---|
| 2012/0286917 | A1 | 11/2012 | Uchida et al. | |
| 2014/0077917 | A1 | 3/2014 | Hashimoto | |
| 2014/0247103 | A1 | 9/2014 | Uchida | |
| 2014/0306792 | A1* | 10/2014 | Yoneda | H01F 27/2804 336/200 |

FOREIGN PATENT DOCUMENTS

| | | | |
|---|---|---|---|
| CN | 102804292 | A | 11/2012 |
| CN | 204707339 | U | 10/2015 |
| JP | H06-120065 | A | 4/1994 |
| JP | 2004-88969 | A | 3/2004 |
| JP | 2004-356564 | A | 12/2004 |
| JP | 2006-256942 | A | 9/2006 |
| JP | 5610081 | B2 | 10/2014 |
| JP | 2015-070172 | A | 4/2015 |
| WO | 2010/084794 | A1 | 7/2010 |

* cited by examiner

*Primary Examiner* — Barbara J Musser
(74) *Attorney, Agent, or Firm* — Oliff PLC

(57) ABSTRACT

A method of manufacturing a laminated coil component is a method of manufacturing a laminated coil component provided with a laminate obtained by laminating a coil conductor forming a spiral coil and an insulator layer. The method of manufacturing a laminated coil component includes a step of providing a conductor pattern configured to become a coil conductor on a green sheet configured to become an insulator layer, and a step of laminating a plurality of green sheets provided with the conductor pattern. The conductor pattern includes a pair of first side surfaces opposed to each other in an orthogonal direction orthogonal to a laminating direction of the green sheet. At the step of laminating a plurality of green sheets, a depression is formed on at least one of the pair of first side surfaces.

3 Claims, 8 Drawing Sheets

METHOD OF MANUFACTURING LAMINATED COIL COMPONENT

TECHNICAL FIELD

One aspect of the present invention relates to a method of manufacturing a laminated coil component.

BACKGROUND

Known laminated coil components are provided with laminates obtained by laminating a plurality of insulator layers and inductor conductors interposed between the insulator layers in a laminating direction (for example, Japanese Unexamined Patent Publication No. 2015-070172). A method of manufacturing the laminated coil component includes a step of laminating a plurality of green sheets provided with a conductor pattern to burn.

SUMMARY

In the above-described manufacturing method, a plurality of green sheets is laminated in such a way that the conductor patterns overlap with one another when seen in the laminating direction. However, in some cases, lamination displacement occurs in which the conductor pattern is displaced in an orthogonal direction orthogonal to the laminating direction with respect to the conductor pattern adjacent in the laminating direction.

One aspect of the present invention provides a method of manufacturing a laminated coil component capable of inhibiting lamination displacement.

The inventors of the present invention have investigated and studied the method of manufacturing a laminated coil component capable of inhibiting the lamination displacement. As a result, the present inventors have found the following facts.

When green sheets provided with a conductor pattern are laminated, the conductor pattern is interposed between the green sheets to receive force in a laminating direction. As a result, the conductor pattern is crushed to have a shape expanded in an orthogonal direction. Specifically, the conductor pattern is thick in the laminating direction at the center in the orthogonal direction, and becomes thinner in the laminating direction as it is closer to an end in the orthogonal direction. The conductor pattern includes an inclined surface inclined from the center in the orthogonal direction toward the end. Due to this inclined surface, the conductor pattern is likely to be displaced in the orthogonal direction with respect to the conductor pattern adjacent in the laminating direction.

A method of manufacturing a laminated coil component according to one aspect of the present invention is a method of manufacturing a laminated coil component provided with a laminate obtained by laminating a coil conductor forming a spiral coil and an insulator layer. The method of manufacturing a laminated coil component includes a step of providing a conductor pattern configured to become a coil conductor on a green sheet configured to become an insulator layer, and a step of laminating a plurality of green sheets provided with the conductor pattern. The conductor pattern includes a pair of first side surfaces opposed to each other in an orthogonal direction orthogonal to a laminating direction of the green sheet. At the step of laminating a plurality of green sheets, a depression is formed on at least one of the pair of first side surfaces.

In the method of manufacturing a laminated coil component according to one aspect of the present invention, at least one of the pair of first side surfaces of the conductor pattern does not have a shape expanded in the orthogonal direction but has a shape with the depression at the step of laminating a plurality of green sheets. For this reason, in the conductor pattern, the above-described inclined surface is less likely to be formed between the center in the orthogonal direction and the end in the orthogonal direction formed of the first side surface on which the depression is formed. Therefore, it is possible to inhibit lamination displacement.

At the step of laminating a plurality of green sheets, the depression may be formed on each of the pair of first side surfaces. In this case, at the step of laminating a plurality of green sheets, each of the pair of first side surfaces of the conductor pattern does not have the shape expanded in the orthogonal direction but has the shape with the depression. Therefore, it is further difficult that the above-described inclined surface is formed between the center in the orthogonal direction and each end in the orthogonal direction formed of the first side surface. Therefore, it is possible to further inhibit the lamination displacement.

A method of manufacturing a laminated coil component according to one aspect of the present invention is a method of manufacturing a laminated coil component provided with a laminate obtained by laminating a coil conductor forming a spiral coil and an insulator layer. The method of manufacturing a laminated coil component includes a step of providing a conductor pattern having a trapezoidal cross-section and configured to become the coil conductor on a green sheet configured to become the insulator layer, and a step of laminating a plurality of green sheets provided with the conductor pattern.

In the method of manufacturing the laminated coil component according to one aspect of the present invention, the conductor pattern having the trapezoidal cross-section is interposed between the green sheets to be crushed at the step of laminating a plurality of green sheets. For example, when the conductor pattern having a semicircular cross-section is crushed, the conductor pattern is likely to have a shape expanded in the orthogonal direction. In contrast, when the conductor pattern having the trapezoidal cross-section is crushed, the conductor pattern is less likely to have the shape expanded in the orthogonal direction. Therefore, it is possible to inhibit lamination displacement.

The conductor pattern may also include a second side surface brought into contact with the green sheet at the step of providing the conductor pattern and a third side surface opposing to the second side surface. After the step of laminating the plurality of green sheets, the second side surface may be flatter than the third side surface. In this case, as compared with a case where the third side surface is depressed toward the second side surface and the second side surface is depressed toward the third side surface at the same level as or more than the third side surface, the conductor pattern is less likely to be thin, so that stress concentration in the conductor pattern may be inhibited.

DETAILED DESCRIPTION

Hereinafter, embodiments are described in detail with reference to the accompanying drawings. In the description, the same reference sign is used for the same elements or elements having the same function, and redundant descriptions are omitted.

Figure 1:
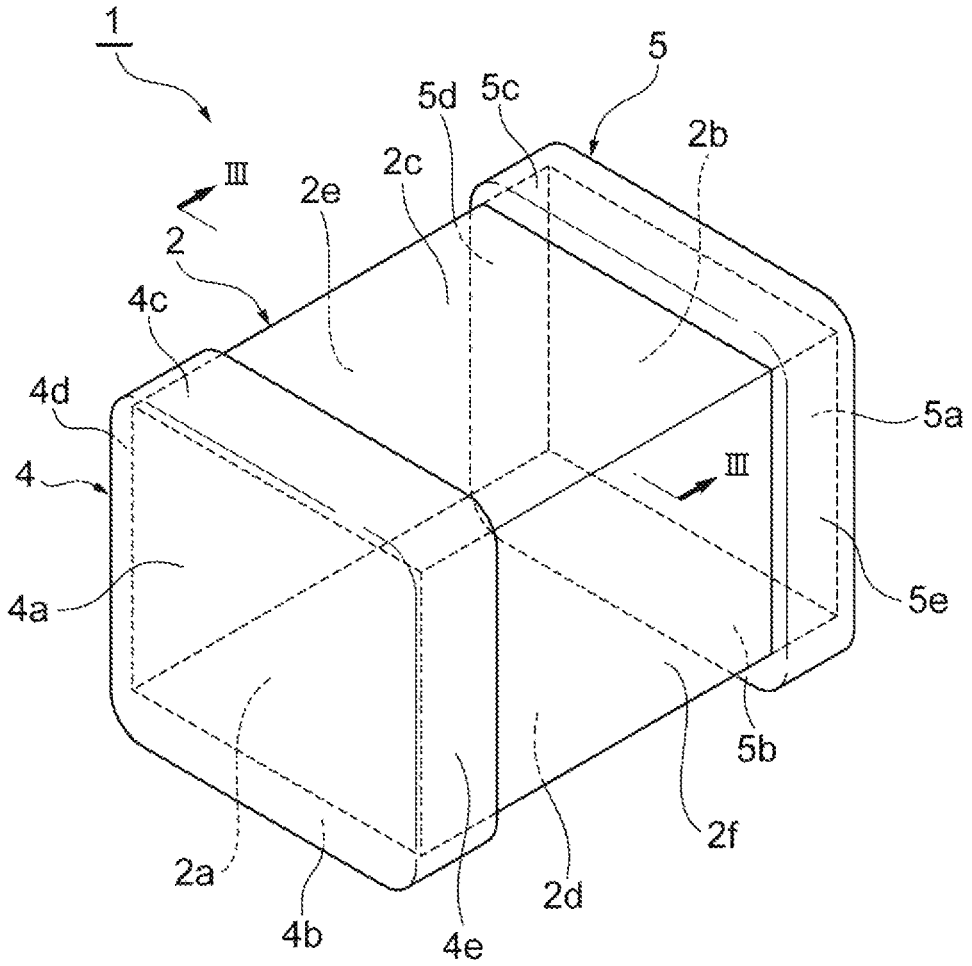
FIG. 1 is a perspective view of a laminated coil component according to an embodiment.
Figure 2:
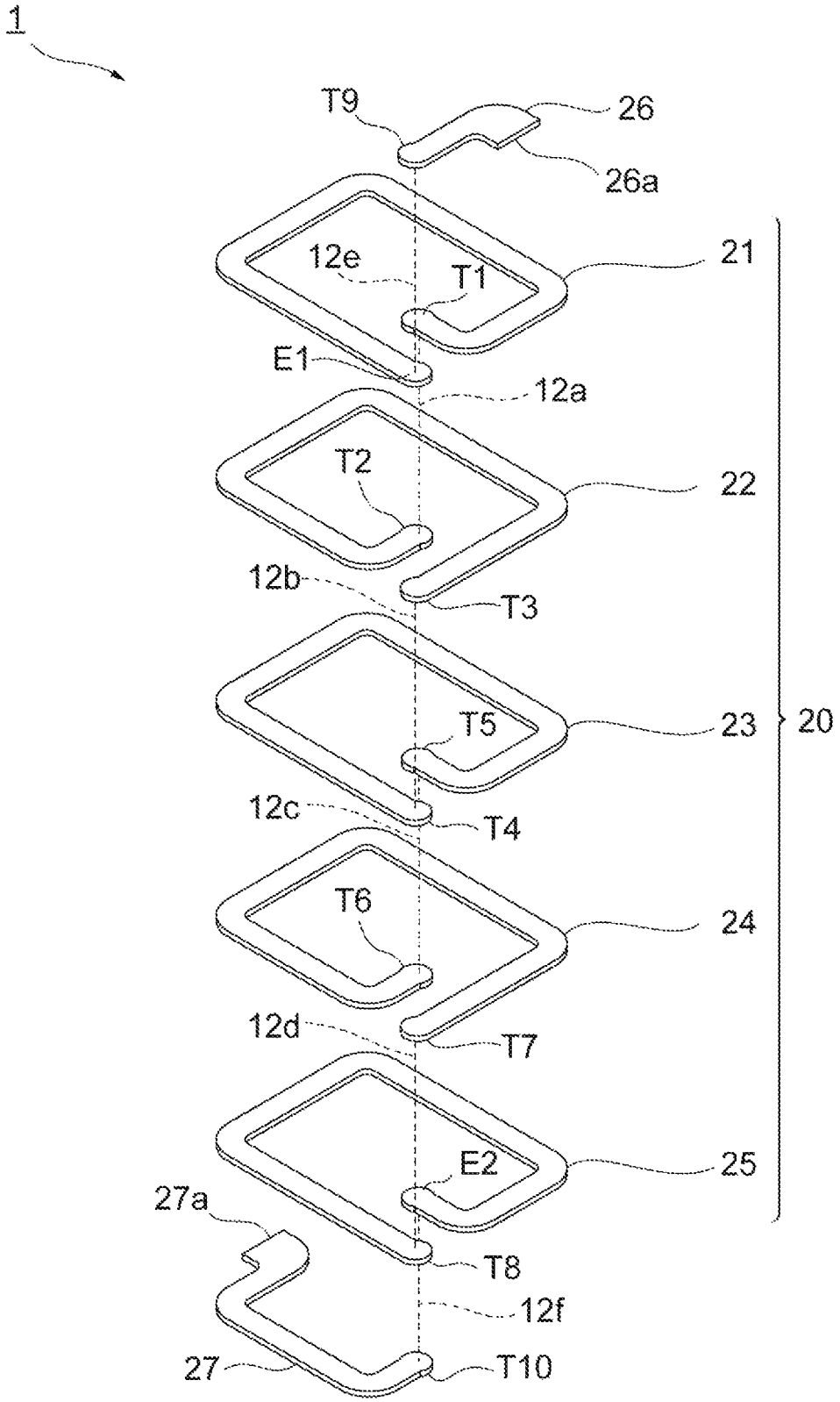
FIG. 2 is an exploded perspective view of the laminated coil component illustrated in FIG. 1.
Figure 3:
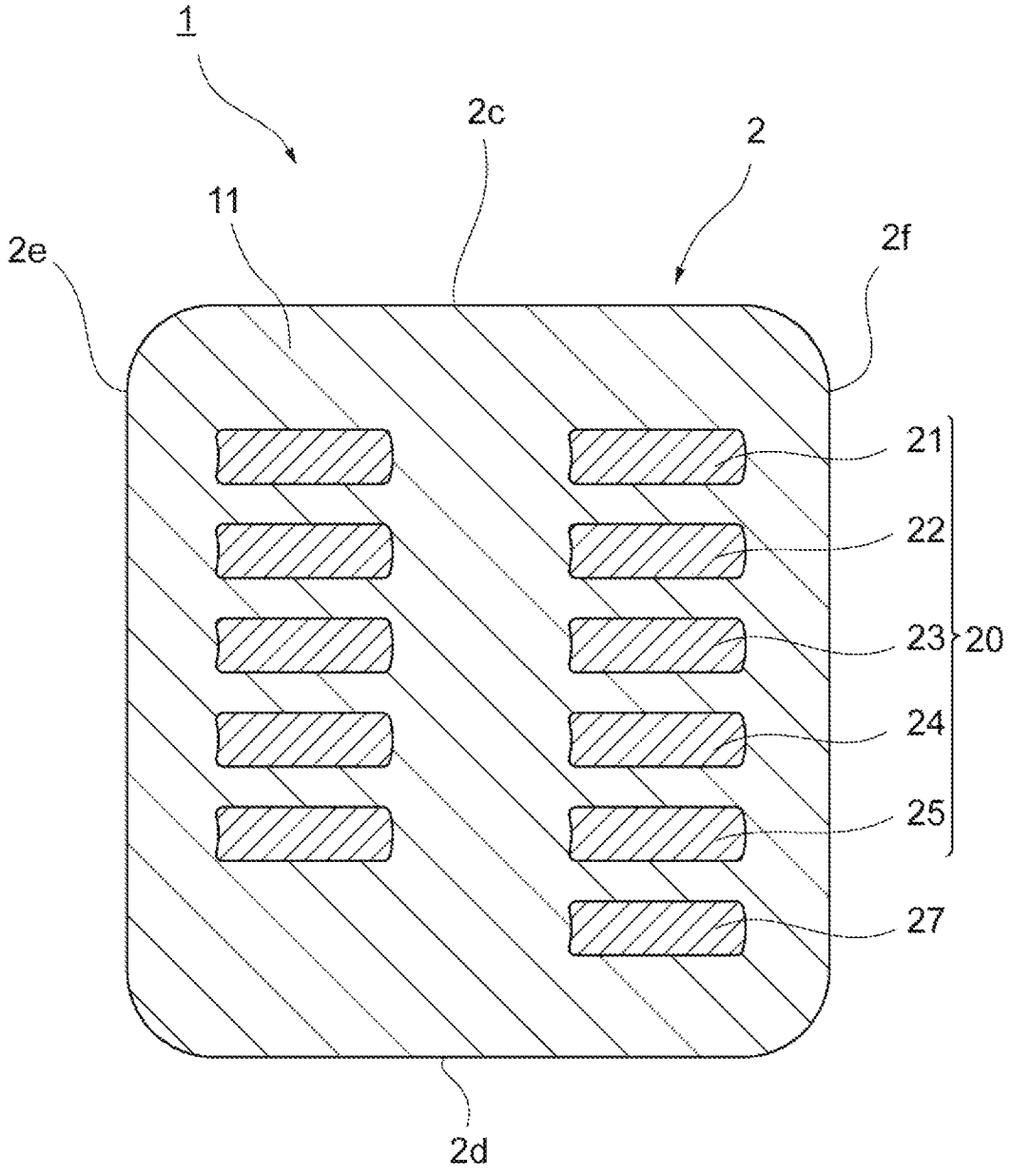
FIG. 3 is a cross-sectional view of the laminated coil component taken along line in FIG. 1.

A laminated coil component according to the embodiment is described with reference to FIGS. 1 to 3. FIG. 1 is a perspective view of a laminated coil component according to an embodiment. FIG. 2 is an exploded perspective view of the laminated coil component illustrated in FIG. 1. FIG. 3 is a cross-sectional view of the laminated coil component taken along line III-III in FIG. 1. In the exploded perspective view in FIG. 2, a plurality of insulator layers forming a laminate and external electrodes disposed at both ends of the laminate are not illustrated. In the cross-sectional view in FIG. 3, the external electrodes disposed at both the ends of the laminate are not illustrated.

As illustrated in FIG. 1, a laminated coil component 1 is provided with a laminate 2 and a pair of external electrodes 4 and 5 disposed at both ends of the laminate 2.

The laminate 2 has a rectangular parallelepiped shape. An outer surface of the laminate 2 includes a pair of end faces 2*a* and 2*b* opposed to each other and four side surfaces 2*c*, 2*d*, 2*e*, and 2*f* extending in an opposing direction of the pair of end faces 2*a* and 2*b* in such a way that the pair of end faces 2*a* and 2*b* are connected to each other. The side surface 2*d* is defined as a surface opposed to another electronic device, for example, when the laminated coil component 1 is mounted on another electronic device not illustrated (for example, a circuit board or an electronic component).

The opposing direction of the end faces 2*a* and 2*b*, an opposing direction of the side surfaces 2*c* and 2*d*, and an opposing direction of the side surfaces 2*e* and 2*f* are substantially orthogonal to one another. The rectangular parallelepiped shape includes a rectangular parallelepiped shape in which a corner and a ridge line are chamfered, and a rectangular parallelepiped shape in which a corner and a ridge line are rounded.

The laminate 2 is obtained by laminating a plurality of insulator layers 11, a plurality of coil conductors 21 to 25, and a plurality of lead conductors 26 and 27. The insulator layers 11 are laminated in the opposing direction of the side surfaces 2*c* and 2*d* of the laminate 2. That is, a laminating direction of the insulator layers 11 coincides with the opposing direction of the side surfaces 2*c* and 2*d* of the laminate 2. Hereinafter, the opposing direction of the side surfaces 2*c* and 2*d* is also referred to as the "laminating direction". Each insulator layer 11 has a substantially rectangular shape when seen in the laminating direction.

Each insulator layer 11 is formed of a sintered body of a ceramic green sheet containing, for example, a magnetic material (Ni—Cu—Zn ferrite material, Ni—Cu—Zn—Mg ferrite material, Ni—Cu ferrite material or the like). In the actual laminate 2, the insulator layers 11 are integrated to such an extent that boundaries between the layers cannot be visually recognized (refer to FIG. 3). The magnetic material of the ceramic green sheet forming each insulator layer 11 may contain an Fe alloy or the like. Each insulator layer 11 may also be formed of a non-magnetic material.

The external electrode 4 is disposed on a side of the end face 2*a* of the laminate 2 and the external electrode 5 is disposed on a side of the end face 2*b* of the laminate 2. That is, the external electrodes 4 and 5 are located in such a way as to be separated from each other in the opposing direction of the pair of end faces 2*a* and 2*b*. Each of the external electrodes 4 and 5 contains a conductive material (for example, Ag, Pd or the like). Each of the external electrodes 4 and 5 is formed as a sintered body of conductive paste containing conductive metal powder (for example, Ag powder, Pd powder or the like) and glass frit. Electroplating is applied to each of the external electrodes 4 and 5, so that a plating layer is formed on the surface thereof. Ni, Sn or the like is used in electroplating, for example.

The external electrode 4 includes five electrode portions: an electrode portion 4*a* located on the end face 2*a*, an electrode portion 4*b* located on the side surface 2*d*, an electrode portion 4*c* located on the side surface 2*c*, an electrode portion 4*d* located on the side surface 2*e*, and an electrode portion 4*e* located on the side surface 2*f*. The electrode portion 4*a* covers an entire surface of the end face 2*a*. The electrode portion 4*b* covers a part of the side surface 2*d*. The electrode portion 4*c* covers a part of the side surface 2*c*. The electrode portion 4*d* covers a part of the side surface 2*e*. The electrode portion 4*e* covers a part of the side surface 2*f*. The five electrode portions 4*a*, 4*b*, 4*c*, 4*d*, and 4*e* are integrally formed.

The external electrode 5 includes five electrode portions: an electrode portion 5*a* located on the end face 2*b*, an electrode portion 5*b* located on the side surface 2*d*, an electrode portion 5*c* located on the side surface 2*c*, an electrode portion 5*d* located on the side surface 2*e*, and an electrode portion 5*e* located on the side surface 2*f* The electrode portion 5*a* covers an entire surface of the end face 2*b*. The electrode portion 5*b* covers a part of the side surface 2*d*. The electrode portion 5*c* covers a part of the side surface 2*c*. The electrode portion 5*d* covers a part of the side surface 2*e*. The electrode portion 5*e* covers a part of the side surface 2*f*. The five electrode portions 5*a*, 5*b*, 5*c*, 5*d*, and 5*e* are integrally formed.

As illustrated in FIGS. 2 and 3, a plurality of coil conductors 21 to 25 and a plurality of lead conductors 26 and 27 are disposed in the laminate 2. The coil conductors 21, 23, and 25 have substantially the same shapes in planar view. The coil conductors 22 and 24 have substantially the same shapes in planar view. Each of the coil conductors 21 to 25 and the lead conductors 26 and 27 has a substantially rectangular cross-section. The cross-sectional shape of each of the coil conductors 21 to 25 and the lead conductors 26 and 27 is described later in detail as a cross-sectional shape of a conductor pattern 32 with reference to FIGS. 4A and 4B.

The coil conductors 21 to 25 and the lead conductors 26 and 27 are disposed in such a way as to be separated from one another in the laminating direction. The insulator layer 11 is disposed between each of the coil conductors 21 to 25 and the lead conductors 26 and 27. The coil conductors 21 to 25 and the lead conductors 26 and 27 have substantially the same thicknesses in the laminating direction. The coil conductors 21 to 25 and the lead conductor 27 are disposed in such a way as to overlap with one another through the insulator layer 11 when seen in the laminating direction. That is, each of the coil conductors 21 to 25 and the lead conductor 27 is interposed between the two insulator layers 11 in the laminating direction. A length in the laminating direction (minimum length) of each insulator layer 11 disposed between each of the coil conductors 21 to 25 and the lead conductor 27 is, for example, shorter than or equal to the length (maximum length) in the laminating direction of each of the coil conductors 21 to 25 and the lead conductor 27.

Ends of the coil conductors 21 to 25 are connected to one another by means of through-hole conductors 12*a* to 12*d*. Specifically, an end T1 of the coil conductor 21 and an end T2 of the coil conductor 22 are connected to each other by means of the through-hole conductor 12*a*. An end T3 of the coil conductor 22 and an end T4 of the coil conductor 23 are connected to each other by means of the through-hole conductor 12*b*. An end T5 of the coil conductor 23 and an end T6 of the coil conductor 24 are connected to each other by the through-hole conductor 12*c*. An end T7 of the coil conductor 24 and an end T8 of the coil conductor 25 are connected to each other by the through-hole conductor 12*d*.

In this manner, since the ends T1 to T8 of the coil conductors 21 to 25 are connected to one another by means of the through-hole conductors 12*a* to 12*d*, a spiral coil 20 is formed in the laminate 2. That is, the laminated coil component 1 is provided with the coil 20 in the laminate 2. The coil 20 includes a plurality of coil conductors 21 to 25 separated from one another in the laminating direction and electrically connected to one another. The coil 20 has an axial center in the laminating direction.

The coil conductors 21 to 25 are disposed in this order in the laminating direction. The coil conductor 21 out of the coil conductors 21 to 25 is disposed in a position the closest to the side surface 2*c* of the laminate 2 in the laminating direction. An end E1 of the coil conductor 21 forms one end E1 of the coil 20. The coil conductor 25 out of the coil conductors 21 to 25 is disposed in a position the closest to the side surface 2*d* of the laminate 2 in the laminating direction. An end E2 of the coil conductor 25 forms the other end E2 of the coil 20.

The lead conductor 26 is disposed on a side closer to the side surface 2*c* of the laminate 2 in the laminating direction than the coil conductor 21. The lead conductor 26 and the coil conductor 21 are adjacent to each other in the laminating direction. An end T9 of the lead conductor 26 is connected to the end E1 of the coil conductor 21 by means of the through-hole conductor 12*e*. That is, the lead conductor 26 and the end E1 of the coil 20 are connected to each other by means of the through-hole conductor 12*e*.

An end 26*a* of the lead conductor 26 is exposed on the end face 2*b* of the laminate 2 to be connected to the electrode portion 5*a* of the external electrode 5 covering the end face 2*b*. That is, the lead conductor 26 and the external electrode 5 are connected to each other. Therefore, the end E1 of the coil 20 and the external electrode 5 are electrically connected to each other by means of the lead conductor 26 and the through-hole conductor 12*e*.

The lead conductor 27 is disposed on a side closer to the side surface 2*d* of the laminate 2 in the laminating direction than the coil conductor 25. The lead conductor 27 and the coil conductor 25 are adjacent to each other in the laminating direction. An end T10 of the lead conductor 27 is connected to the end E2 of the coil conductor 25 by means of the through-hole conductor 12*f*. That is, the lead conductor 27 and the end E2 of the coil 20 are connected to each other by means of the through-hole conductor 12*f*.

An end 27*a* of the lead conductor 27 is exposed on the end face 2*a* of the laminate 2 to be connected to the electrode portion 4*a* of the external electrode 4 covering the end face 2*a*. That is, the lead conductor 27 and the external electrode 4 are connected to each other. Therefore, the end E2 of the coil 20 and the external electrode 4 are electrically connected to each other by means of the lead conductor 27 and the through-hole conductor 12*f*.

Each of the coil conductors 21 to 25, each of the lead conductors 26 and 27, and each of the through-hole conductors 12*a* to 12*f* contains, for example, a conductive material (for example, Ag or Pd). Each of the coil conductors 21 to 25, each of the lead conductors 26 and 27, and each of the through-hole conductors 12*a* to 12*f* is formed as a sintered body of conductive paste containing conductive metal powder (for example, Ag powder or Pd powder). For example, metal oxide ($TiO_2$, $Al_2O_3$, and $ZrO_2$) may be contained in each of the coil conductors 21 to 25, each of the lead conductors 26 and 27, and each of the through-hole conductors 12*a* to 12*f*. In this case, each of the coil conductors 21 to 25, each of the lead conductors 26 and 27, and each of the through-hole conductors 12*a* to 12*f* is formed as a sintered body of the conductive paste containing the metal oxide described above. In this case, it is possible to decrease a shrinkage rate at the time of burning the conductive paste.

Figure 4A:
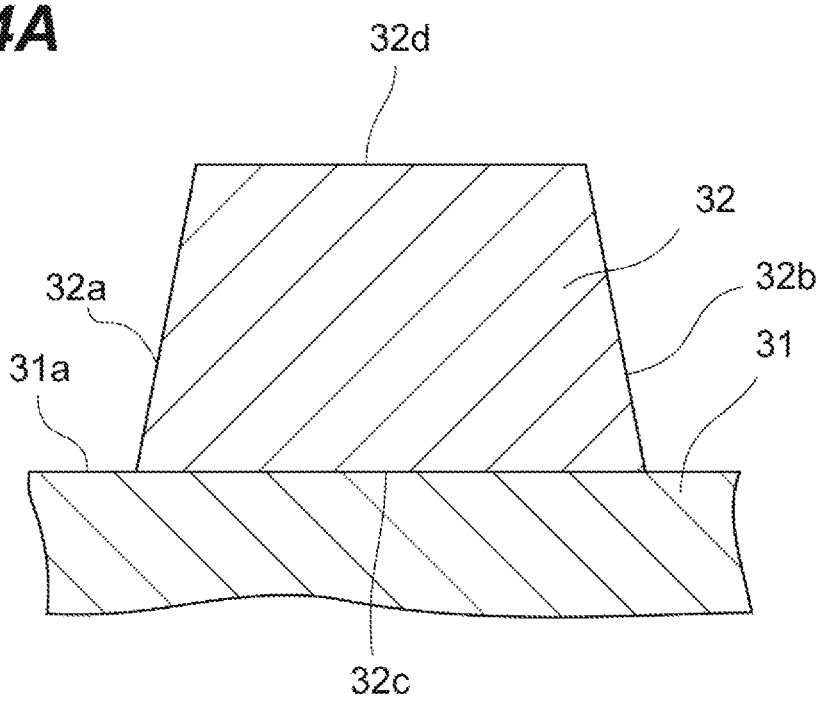
FIGS. 4A and 4B are cross-sectional views of a conductor pattern.
Figure 4B:
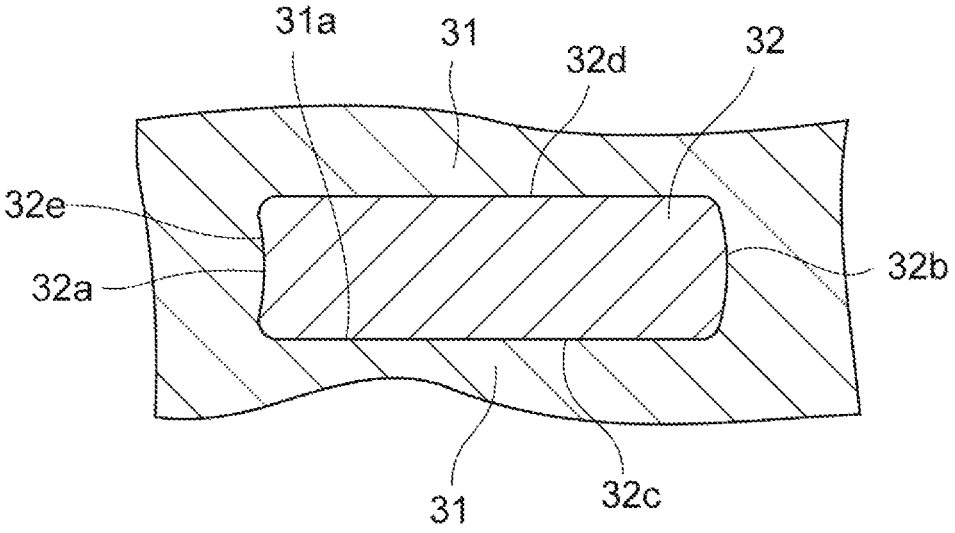

A method of manufacturing the laminated coil component 1 is next described with reference to FIGS. 4A and 4B. FIGS. 4A and 4B are cross-sectional views of a conductor pattern.

First, binder resin or the like is mixed with ferrite powder being a main component of the laminate 2 to prepare insulator slurry. The prepared insulator slurry is applied onto a base material (for example, a PET film or the like) by a doctor blade method to form an insulator green sheet 31 (refer to FIG. 4A) configured to become the insulator layer 11. The insulator green sheet 31 has a main surface 31*a*. Next, a through-hole is formed by laser processing in a position where the through-hole conductors 12*a* to 12*f* (refer to FIG. 2) are to be formed on the insulator green sheet 31.

Next, the through-hole on the insulator green sheet 31 is filled with first conductive paste. The first conductive paste is prepared by mixing the conductive metal powder, the binder resin and the like. Subsequently, as illustrated in FIG. 4A, the first conductive paste is applied onto the main surface 31*a* of the insulator green sheet 31 to provide the conductor pattern 32 configured to become each of the coil conductors 21 to 25 and the lead conductors 26 and 27. At that time, the conductor pattern 32 is connected to the conductive paste in the through-hole.

A cross-section of the conductor pattern 32 has a trapezoidal shape. The conductor pattern 32 includes a pair of side surfaces 32*a* and 32*b* opposing to each other in a width direction (direction along the main surface 31*a*), and a pair of side surfaces 32*c* and 32*d* opposing to each other in a height direction (direction orthogonal to the main surface 31*a*). The width direction corresponds to the orthogonal direction, and the height direction corresponds to the laminating direction. The side surface 32*c* is a surface brought into contact with the main surface 31*a* of the insulator green sheet 31 at a step of providing the conductor pattern 32. The pair of side surfaces 32*c* and 32*d* is substantially parallel to the main surface 31*a*. A width of the conductor pattern 32 is maximum at the side surface 32*c* and minimum at the side surface 32*d*, and gradually decreases from the side surface 32*c* toward the side surface 32*d*. An aspect ratio being a ratio of height (maximum height) to width (maximum width) of the cross-section of the conductor pattern 32 is not smaller than 0.5 and smaller than 1.0 or not smaller than 0.7 and smaller than 1.1, for example. The center in the width direction of the side surface 32*c* and the center in the width direction of the side surface 32*d* overlap with each other as seen in the height direction.

Next, the insulator green sheet 31 is laminated. Herein, a plurality of insulator green sheets 31 provided with the conductor pattern 32 is peeled off from the base material to be laminated, and pressurized in the laminating direction to form laminate green. At that time, the insulator green sheets 31 are laminated in such a way that the conductor patterns 32 are overlapped with one another when seen in the laminating direction. The conductor patterns 32 configured to become the coil conductors 21 to 25 and the lead conductor 27. At a step of laminating the insulator green sheets 31, the conductor pattern 32 is interposed between the insulator green sheets 31 and receives force in the laminating direction. Accordingly, as illustrated in FIG. 4B, the conductor pattern 32 is crushed in the laminating direction.

In a crushed state, an aspect ratio being a ratio of length (maximum length) in the laminating direction to length (maximum length) in the orthogonal direction of the cross-section of the conductor pattern 32 is, for example, not smaller than 0.2 and not larger than 0.3. At that time, a depression 32*e* is formed on at least one of the pair of side surfaces 32*a* and 32*b*. Herein, the depression 32*e* is formed on the side surface 32*a*. The depression 32*e* is depressed toward the side surface 32*b*. The side surface 32*b* has a shape in which the center in the laminating direction is protruded (expanded) in the orthogonal direction. The pair of side surfaces 32*c* and 32*d* is substantially parallel in the orthogonal direction.

Next, the laminate green is cut into chips of a predetermined size by a cutting machine to obtain a green chip. Next, after removing the binder resin contained in each part from the green chip, the green chip is burned. Thereby, the laminate 2 is obtained. The cross-sectional shape of each of the coil conductors 21 to 25 and the lead conductor 27 illustrated in FIG. 3 is equivalent to the cross-sectional shape of the conductor pattern 32 in the crushed state described above illustrated in FIG. 4B. Next, second conductive paste is provided on each of the pair of end faces 2*a* and 2*b* of the laminate 2. The second conductive paste is prepared by mixing the conductive metal powder, the glass frit, the binder resin and the like. Subsequently, by applying heat treatment, the second conductive paste is baked to the laminate 2 to form a pair of external electrodes 4 and 5. Electroplating may be applied to the surfaces of the pair of external electrodes 4 and 5 to form plating layers. The laminated coil component 1 is obtained by the above-described steps.

Figure 5A:
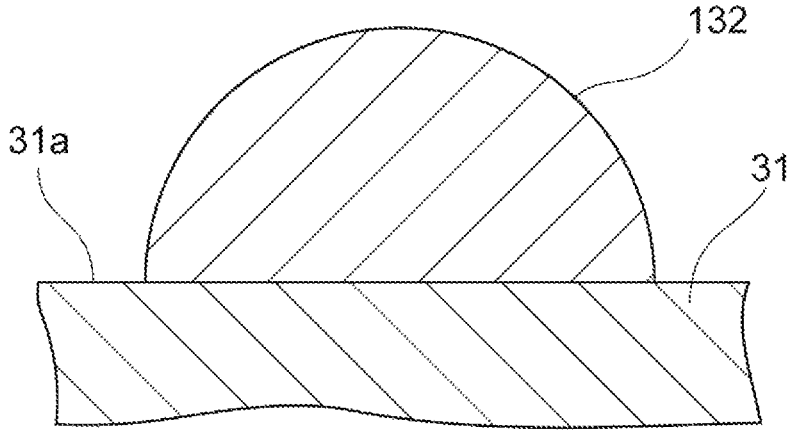
FIGS. 5A and 5B are cross-sectional views of a conductor pattern according to a comparative example.
Figure 5B:
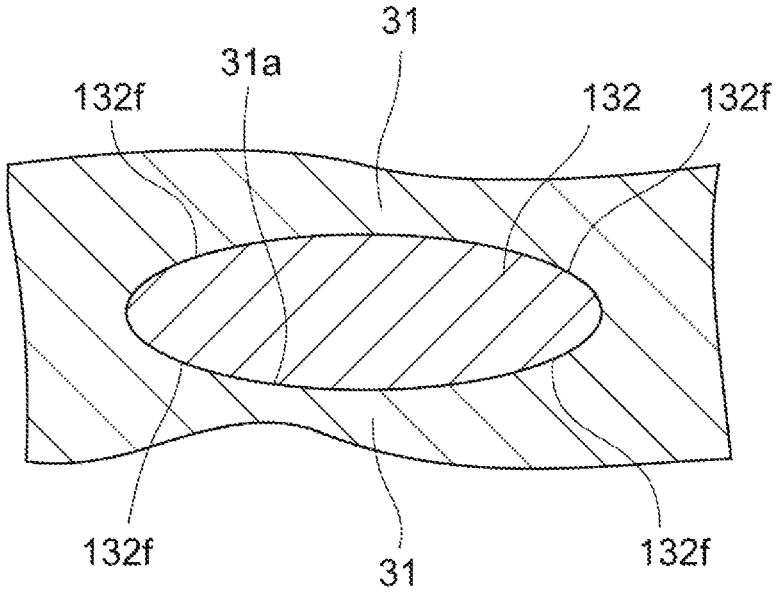
Figure 6:
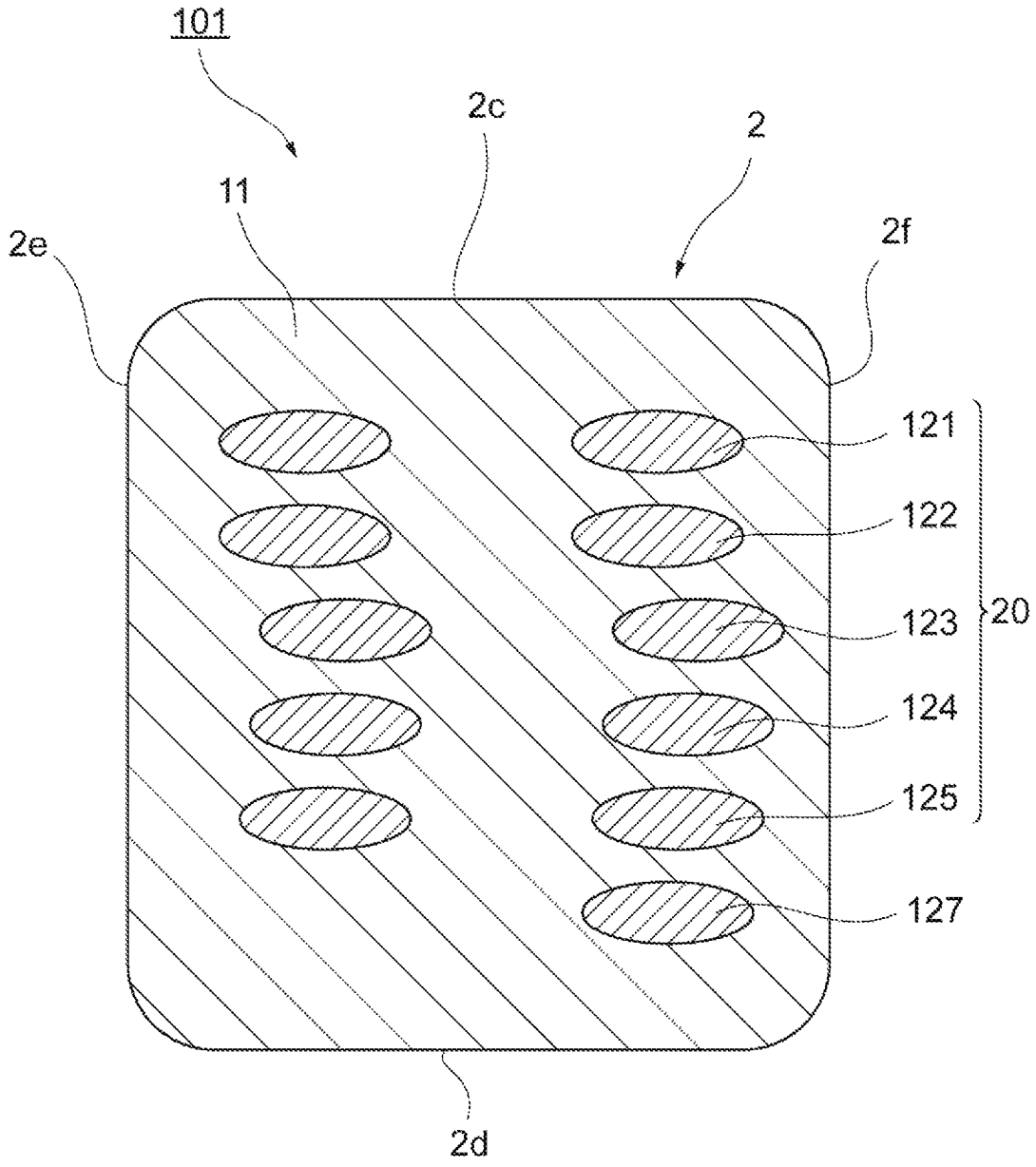
FIG. 6 is a cross-sectional view of a laminated coil component according to the comparative example.

Next, a function effect of the laminated coil component 1 according to this embodiment is described while describing a comparative example with reference to FIGS. 5A, 5B, and 6. FIGS. 5A and 5B are cross-sectional views of a conductor pattern according to a comparative example. FIG. 6 is a cross-sectional view of a laminated coil component according to the comparative example.

A method of manufacturing the laminated coil component according to the comparative example differs from the method of manufacturing the laminated coil component 1 according to the embodiment in terms of a shape of a conductor pattern 132, but coincides with the same in all other terms. In the comparative example, as illustrated in FIG. 5A, the conductor pattern 132 has a semicircular cross-section. That is, the conductor pattern 132 has a semi-cylindrical shape, and an aspect ratio of the cross-section of the conductor pattern 132 is, for example, not larger than 0.3.

When the insulator green sheets 31 provided with the conductor pattern 132 having such a shape on the main surface 31*a* are laminated, the conductor pattern 132 is crushed to have a shape expanding in the orthogonal direction as illustrated in FIG. 5B. Specifically, the conductor pattern 132 has a shape thick in the laminating direction at the center in the orthogonal direction, thinner in the laminating direction as it is closer to the end in the orthogonal direction, ant with an inclined surface 132*f* inclined from the center in the orthogonal direction toward the end.

Due to such inclined surface 132*f*, the conductor pattern 132 is likely to be displaced in the orthogonal direction with respect to the adjacent conductor pattern 132. As a result, as illustrated in FIG. 6, in a laminated coil component 101 according to the comparative example, a large number of lamination displacements occur. The laminated coil component 101 according to the comparative example is different from the laminated coil component 1 according to the embodiment in terms of the cross-sectional shape of each of the coil conductors 121 to 125, the lead conductor 126 (not illustrated), and the lead conductor 127, and the lamination displacement resulting from the shape, but coincides with the same in all other terms.

In contrast, in the method of manufacturing the laminated coil component 1, the conductor pattern 32 having a trapezoidal cross-section is provided on the main surface 31*a* of the insulator green sheet 31. The conductor pattern 32 is interposed between the insulator green sheets 31 to be crushed at a step of laminating a plurality of insulator green sheets 31. Since the conductor pattern 32 having the trapezoidal cross-section is crushed in this manner, the conductor pattern 32 is less likely to have a shape expanded in the orthogonal direction.

In the conductor pattern 32, at least one of the pair of side surfaces 32*a* and 32*b* does not have a shape expanded in the orthogonal direction but has the shape with the depression 32*e*. For this reason, the above-described inclined surface 132*f* is less likely to be formed between the center in the orthogonal direction and the end in the orthogonal direction in the conductor pattern 32. As a result, as illustrated in FIG. 3, it is possible to inhibit the lamination displacement in the laminated coil component 1. Although FIG. 3 illustrates a case where there is no lamination displacement at all as an example, even if the lamination displacement occurs, in the laminated coil component 1, a large number of lamination displacements as in the laminated coil component 101 are less likely to occur.

The present invention is not limited to the above-described embodiment, and various modifications may be made.

Figure 7A:
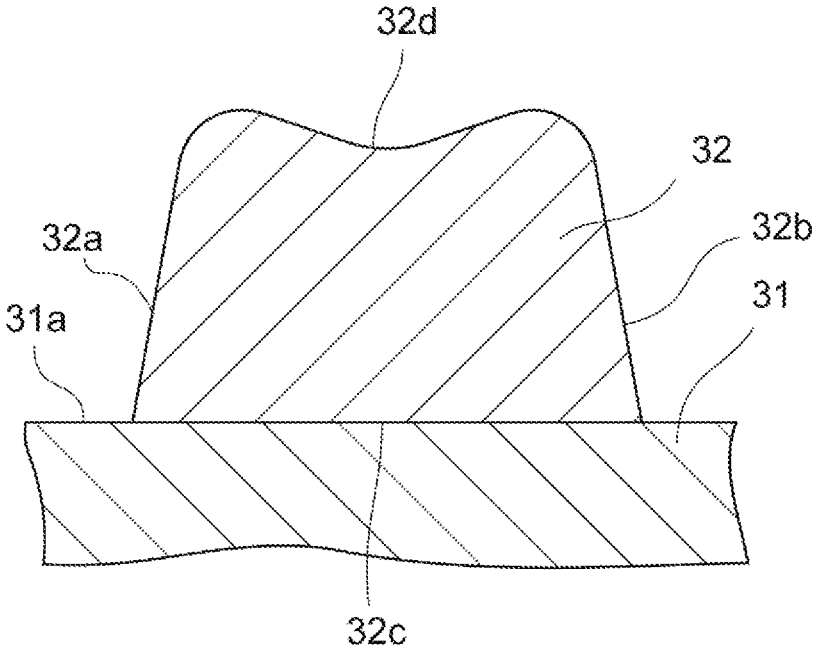
FIGS. 7A and 7B are cross-sectional views of a conductor pattern according to a variation.
Figure 7B:
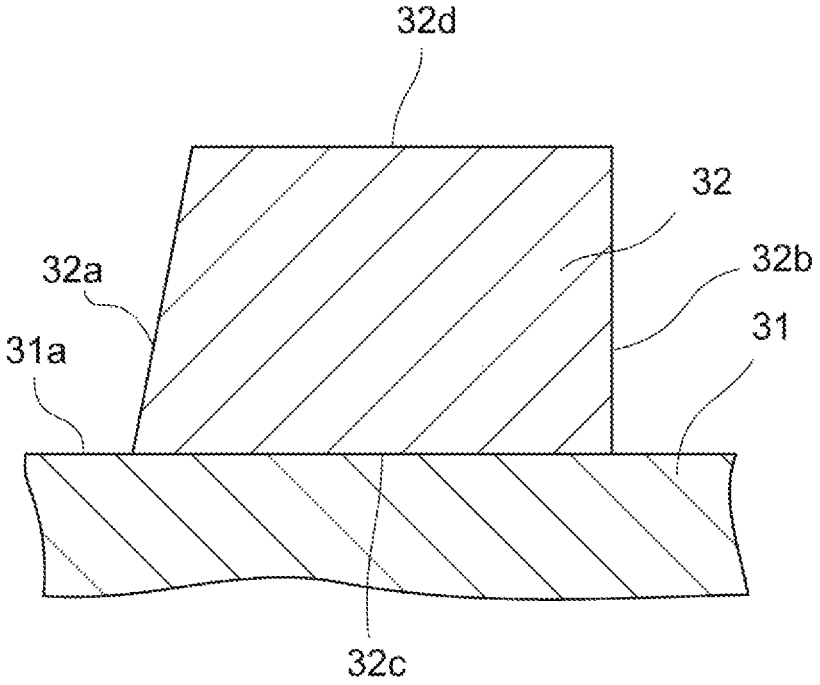

FIGS. 7A, 7B, 8A, and 8B are cross-sectional views of a conductor pattern according to a variation. As illustrated in FIG. 7A, at a step of providing the conductor pattern 32 on the main surface 31*a* of the insulator green sheet 31, the conductor pattern 32 may have, for example, a shape in which the central portion in the width direction of the side surface 32*d* is depressed toward the side surface 32*c*. As illustrated in FIG. 7B, the center in the width direction of the side surface 32*c* and the center in the width direction of the side surface 32*d* do not have to overlap with each other as seen in the height direction.

Figure 8A:
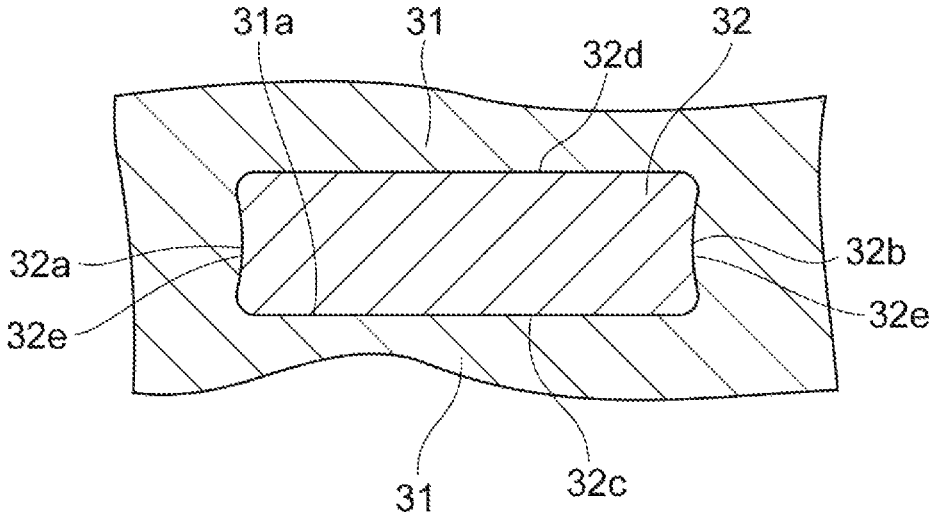
FIGS. 8A and 8B are cross-sectional views of the conductor pattern according to the variation.
Figure 8B:
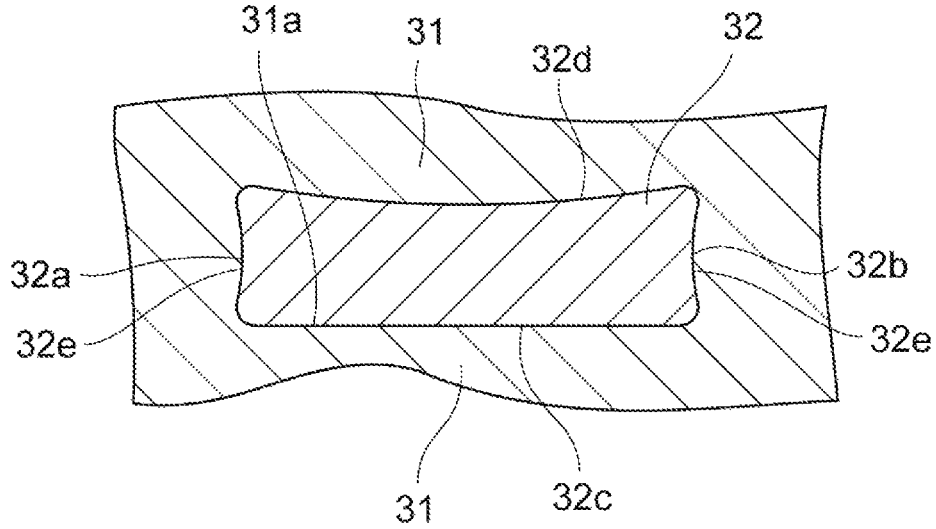

As illustrated in FIG. 8A, at a step of laminating a plurality of insulator green sheets 31, for example, the conductor pattern 32 may be crushed and the depression 32*e* may be formed on each of the pair of side surfaces 32*a* and 32*b*. In this case, it is further difficult that the above-described inclined surface 132*f* is formed in the conductor pattern 32 between the center in the orthogonal direction and the end in the orthogonal direction. Therefore, it is possible to further inhibit the lamination displacement. As illustrated in FIG. 8B, the center in the orthogonal direction of the side surface 32*d* may also be depressed toward the side surface 32*c*. That is, the side surface 32*c* may be flatter than the side surface 32*d*. In a case where the center in the orthogonal direction of the side surface 32*c* is depressed toward the side surface 32*d* at the same level as or more than the side surface 32*d*, a difference between thickness (length in the laminating direction) of the conductor pattern 32 in a portion where influence of the depression is large and thickness of the conductor pattern 32 in a portion where the influence of the depression is small increases. In a case where the side surface 32*c* is flatter than the side surface 32*d*, this difference may be inhibited. That is, since the conductor pattern 32 is less likely to become thin, stress concentration in the conductor pattern 32 may be inhibited.

The depressions 32*e* may be continuously formed in a length direction of the conductor pattern 32 or may be formed intermittently in the length direction of the conductor pattern 32. Two or more depressions 32*e* may be formed side by side in the laminating direction.

What is claimed is:

1. A method of manufacturing a laminated coil component provided with a laminate obtained by laminating a coil conductor forming a spiral coil and an insulator layer, the method comprising steps of:

providing a conductor pattern configured to become the coil conductor on a green sheet configured to become the insulator layer; and laminating a plurality of green sheets provided with the conductor pattern, wherein the conductor pattern includes a pair of first side surfaces opposed to each other in an orthogonal direction orthogonal to a laminating direction of the green sheets, and a depression is formed on at least one of the pair of first side surfaces at the step of laminating the plurality of green sheets.

2. The method for manufacturing a laminated coil component according to claim 1, wherein the depression is formed on each of the pair of first side surfaces at the step of laminating the plurality of green sheets.

3. The method of manufacturing a laminated coil component according to claim 1, wherein the conductor pattern includes a second side surface brought into contact with the green sheet at the step of providing the conductor pattern and a third side surface opposing to the second side surface, and after the step of laminating the plurality of green sheets, the second side surface is flatter than the third side surface.

* * * * *